United States Patent [19]

Hulse et al.

[11] Patent Number: 4,635,692

[45] Date of Patent: Jan. 13, 1987

[54] WORKBENCH

[75] Inventors: Anthony J. Hulse, Walton; Neville G. Hulse, Rugeley; Terence Egan, Solihull, all of England

[73] Assignee: Meritcraft Ltd., Martindale, England

[21] Appl. No.: 684,581

[22] Filed: Dec. 21, 1984

[30] Foreign Application Priority Data

Dec. 22, 1983 [GB] United Kingdom ..... 8334147

[51] Int. Cl.[4] ..... B27C 9/00; B25N 1/04

[52] U.S. Cl. ..... 144/286 R; 83/574; 108/159; 144/1 R

[58] Field of Search ..... 144/1 R, 285, 286 R, 144/286 A; 83/574, 477.2; 108/159

[56] References Cited

U.S. PATENT DOCUMENTS

| | | | |
|---|---|---|---|
| 2,660,205 | 11/1953 | Yetter | 144/1 R |
| 3,734,151 | 5/1973 | Skripsky | 144/286 R |
| 4,133,360 | 1/1979 | Sanfilippo et al. | 83/574 |
| 4,186,784 | 2/1980 | Stone | 144/1 R |
| 4,350,193 | 9/1982 | McCambridge et al. | 144/1 R |

*Primary Examiner*—W. D. Bray

*Attorney, Agent, or Firm*—Holman & Stern

[57] ABSTRACT

A workbench has a cast metal top part having a through aperture into which a variety of tool-carrying adaptor plates can be closely fitted and secured so that cutting elements of the tools project upwardly of the surfaces of the adaptor plates, these surfaces being co-planar with an upper support surface of the top part. The top part also includes provision for mounting a variety of tool holding devices, and further includes clamping rails to which a variety of accessories may be secured.

5 Claims, 13 Drawing Figures

WORKBENCH

BACKGROUND OF THE INVENTION

This invention relates to a semi-portable workbench suitable for domestic use, or for small scale production use, and is adapted for use with a variety of tools which may be electrically driven, for example routing, drilling, planing or jigsawing tools, or others.

There are in existence stands for such tools, each stand being specially adapted for the particular tool, both as to the attachment arrangements for the tool and to the layout of the stand itself, for example to provide cutting clearance in various places. Thus to provide a complete set of equipment several stands of different specific kinds are needed. Moreover several tools, including planing tools, include portions which are housed below the working surface of the bench or stand, and thus a specially shaped opening is required in the working surface.

SUMMARY OF THE INVENTION

It is an object of the invention to provide a relatively small workbench which is suitable for use domestically or for light production work.

It is an object of the invention to provide a relatively small workbench adapted for mounting a variety of power tools of the type which are commonly available for domestic use, and in which change from one type of tool to another may be simply and speedily effected.

According to the invention a workbench comprises a first part having a support plane provided with a through aperture, and a plurality of adaptor plates, each of said plates being separately shaped to fit closely into said aperture so that surfaces of said plates are substantially co-planar with said support plane, each of said plates being formed to receive and locate one or more power tools, and co-operating means on each said plate and said first part for securing said plates in said aperture.

BRIEF DESCRIPTION OF THE DRAWINGS

The invention will now be described by way of example only and with reference to the accompanying drawings in which.

DETAILED DESCRIPTION OF THE INVENTION

Figure 1:
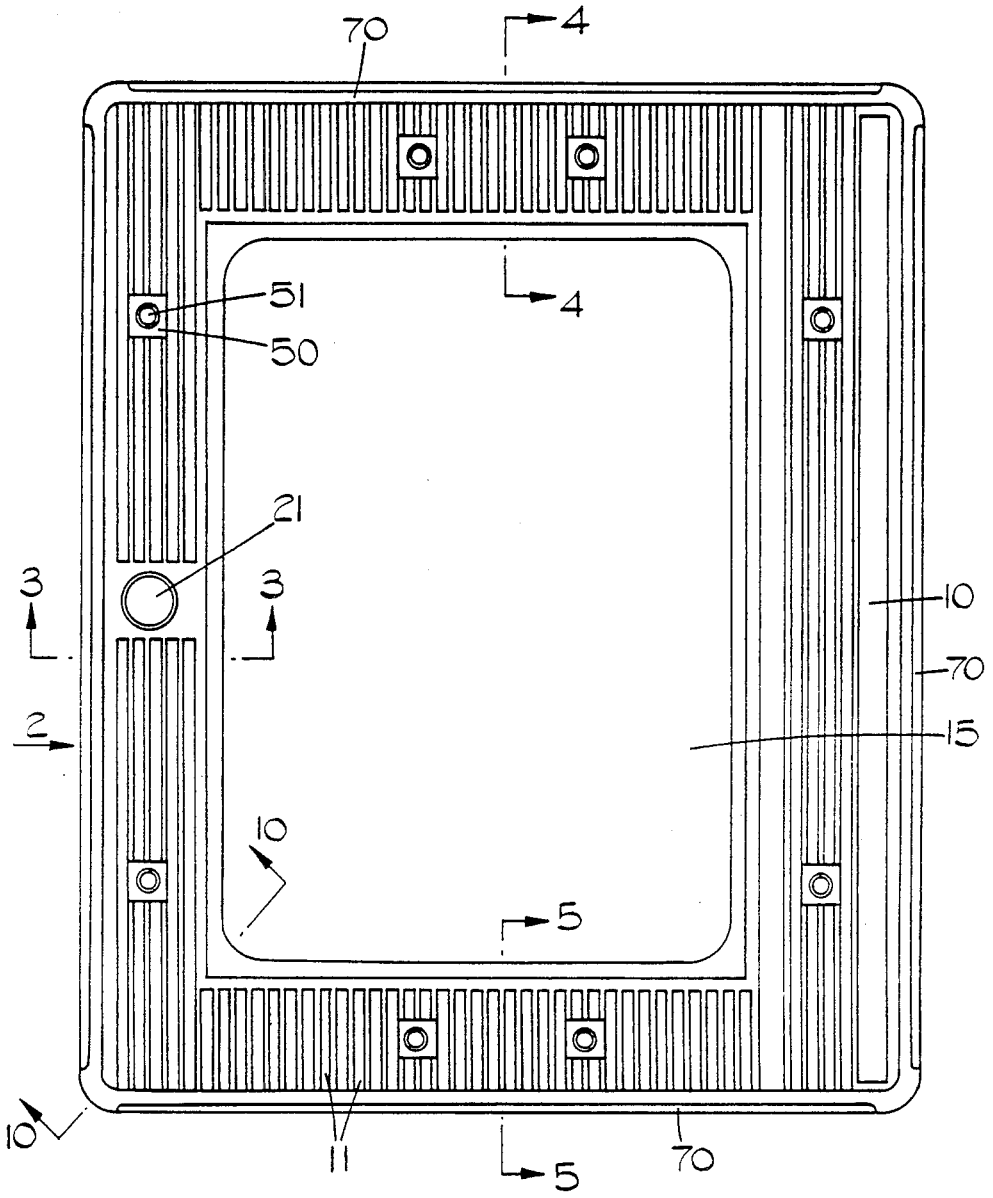
FIG. 1 is a plan view of a workbench according to the invention.
Figure 2:
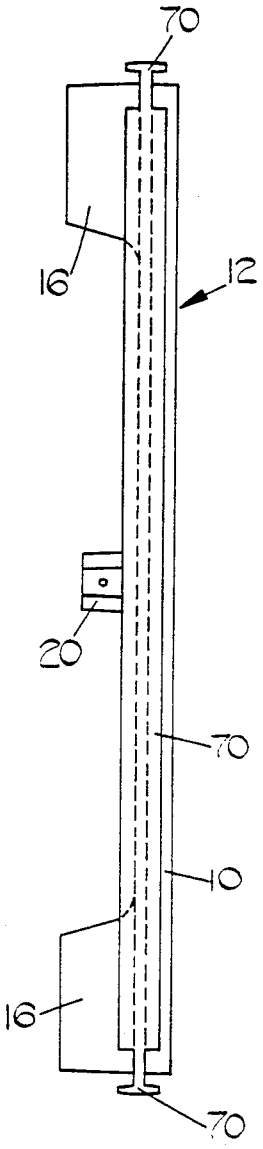
FIG. 2 is a view on arrow 2 in FIG. 1.
Figure 3:
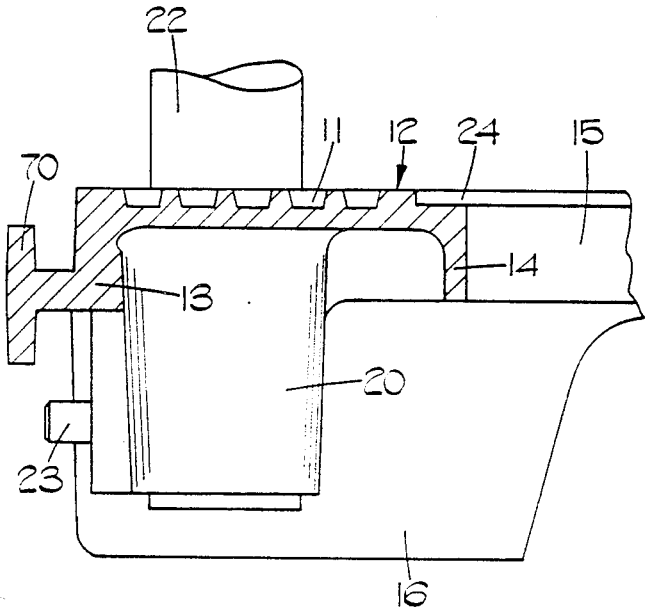
FIG. 3 is section to an enlarged scale on arrows 3—3 in FIG. 1.
Figure 10:
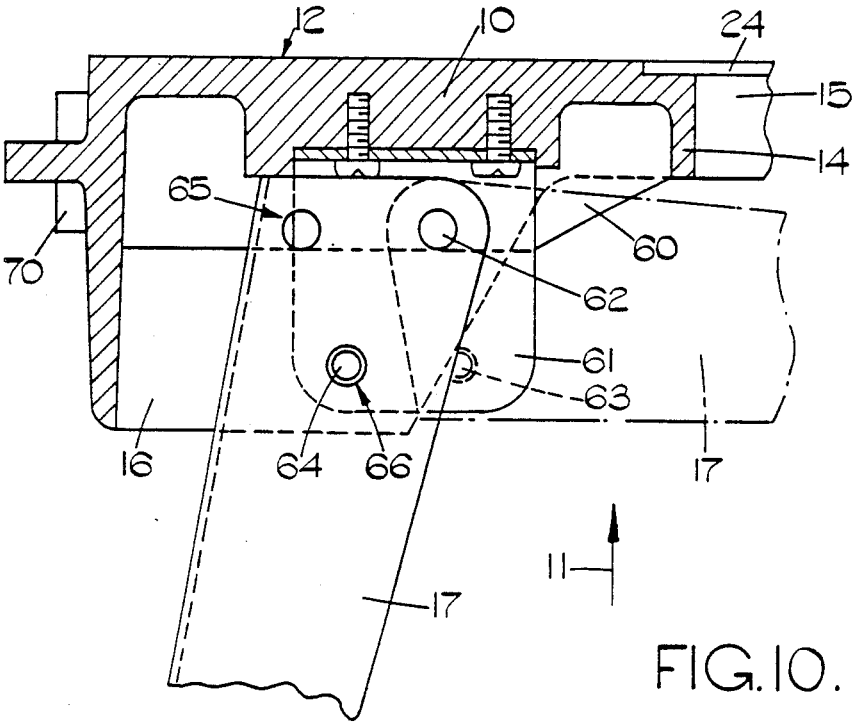
FIG. 10 is a section, to an enlarged scale, on arrows 10—10 in FIG. 1.
Figure 11:
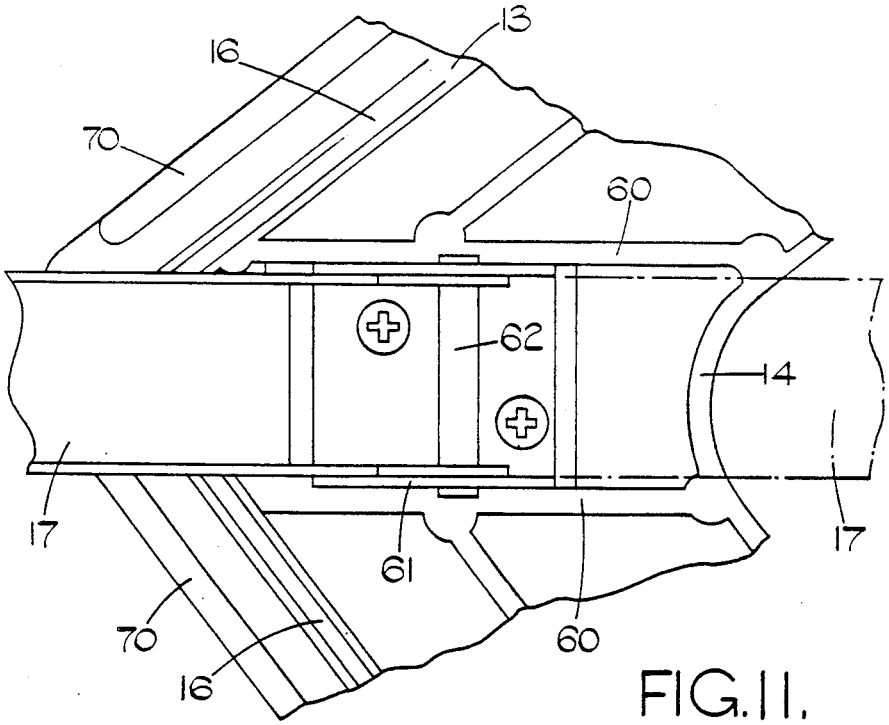
FIG. 11 is a view on arrow 11 in FIG. 10.

As shown in FIGS. 1, 2 and 3 the workbench comprises a cast metal top part 10 having an upper surface which is formed with a plurality of narrow parallel slots 11 to provide a support plane 12. As shown in FIG. 3 the undersurface of the part 10 is provided with integral reinforcing ribs, one rib 13 extending around the periphery of the part 10, and another rib 14 extending round a rectangular through aperture 15 located approximately centrally of the part 10. The rib 13 has portions 16 of greater depth at the corners of the part 10 and contain recesses in which legs, indicated at 17 in FIGS. 10 and 11, are pivotally mounted.

As shown in FIG. 3 the underside of the part 10 has an integrally cast boss 20 which has a through bore 21 for receiving a tool post 22 on which a drill or other tool may be mounted, in a known manner. The post 22 is retained in position by a clamp screw 23.

Figure 7:
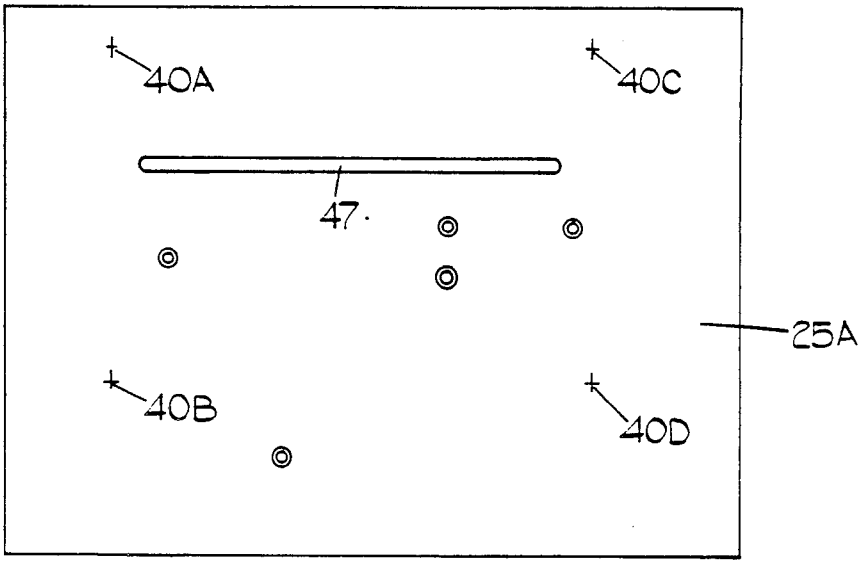
Figure 8:
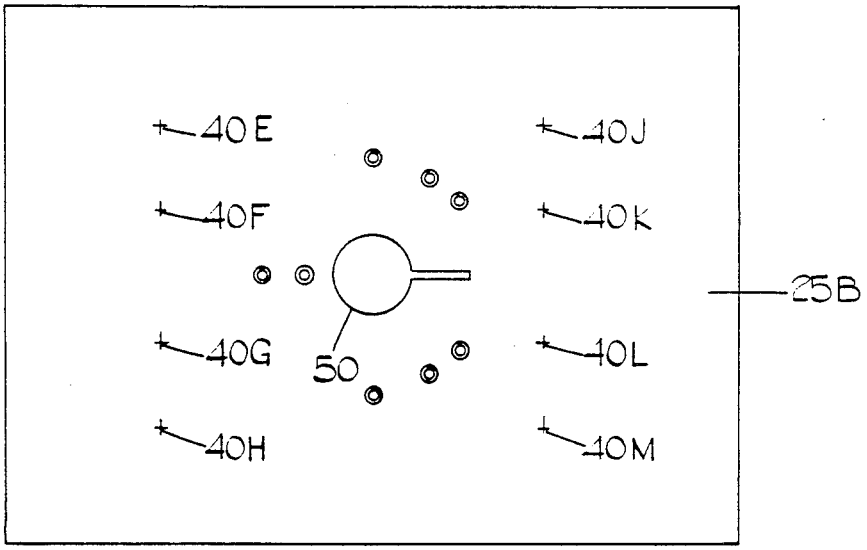

As shown in FIGS. 3, 4, 5 and 10 the sides of the aperture 15 are stepped and define a recess 24 in the upper surface of the part 10, the depth of the recess 24 corresponding to the thicknesses of each of a plurality of mild steel adaptor plates 25, two of which are shown in FIGS. 7 and 8. The plates 25 have identical outside dimensions and fit closely within the recess 24.

Figure 4:
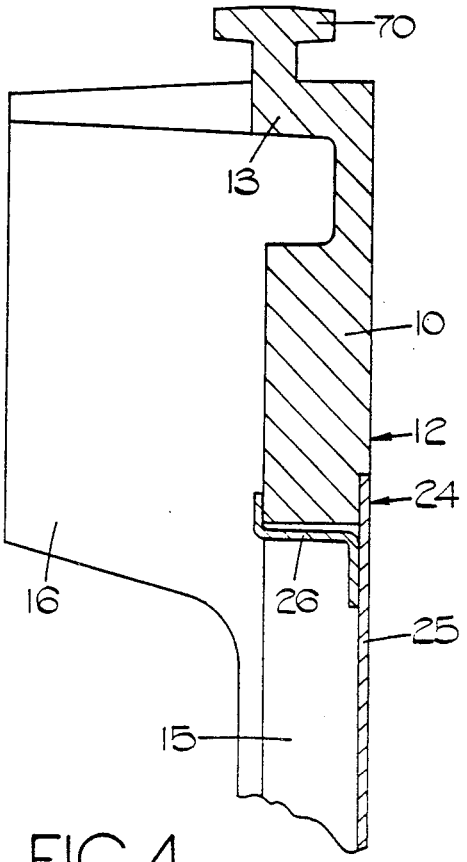
FIGS. 4 and 5 are sections to an enlarged scale on arrows 4—4 and 5—5 respectively in FIG. 1, with an adaptor plate in position.
Figure 5:
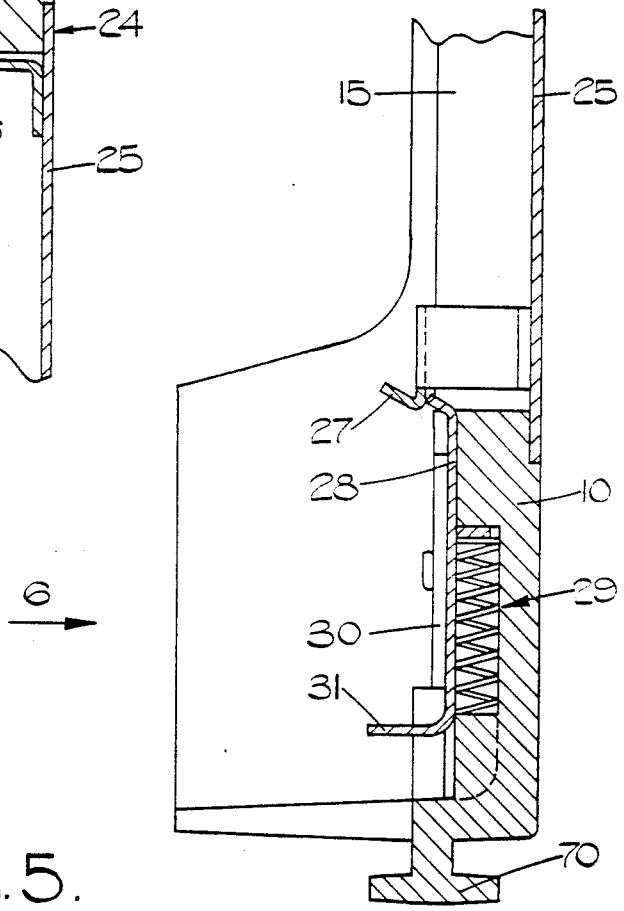
Figure 6:
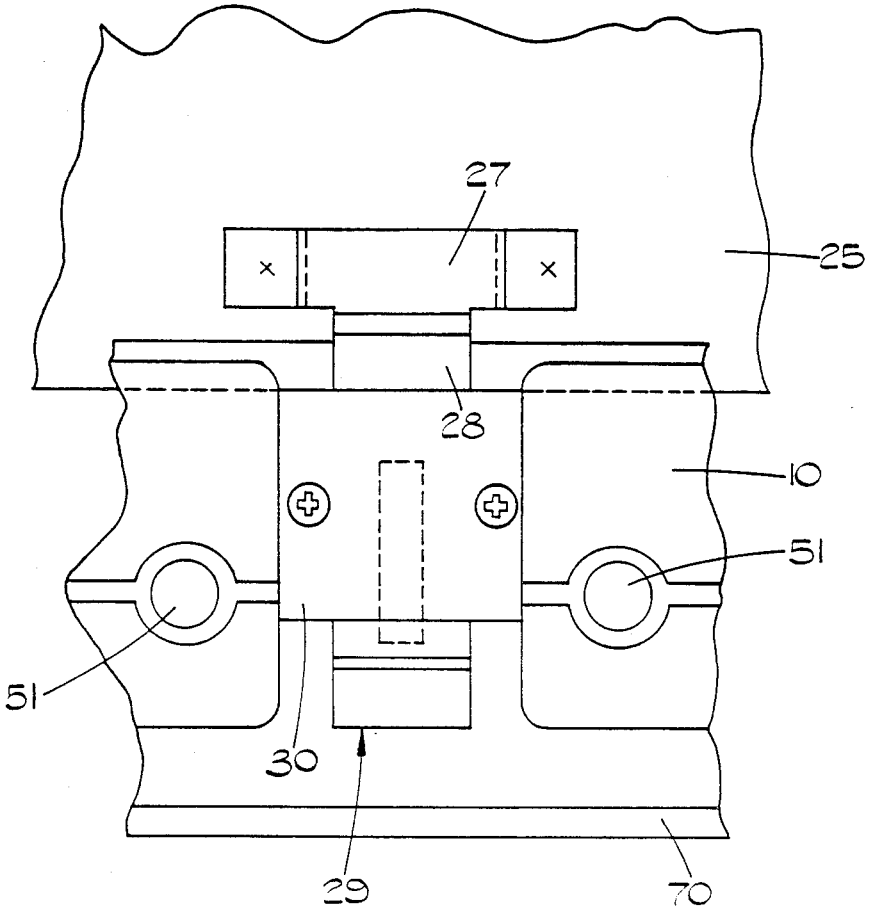
FIG. 6 is a view on arrow 6 in FIG. 5, FIGS. 7 and 8 are plan views, to the scale of FIG. 1, of two types of adaptor plate.

As shown in FIG. 4 one end of each plate 25 has welded thereto a steel tongue 26 which is engageable under an edge of the aperture 15. A steel striker element 27 (FIG. 5) is welded to the other end of each plate 25 and is engageable with a spring biassed latch 28 slidable in a recess 29 in the part 10 and retained therein by a plate 30. A downturned part 31 of the latch 28 enables the latter to be pushed back to release the adaptor plates 25.

Figure 9:
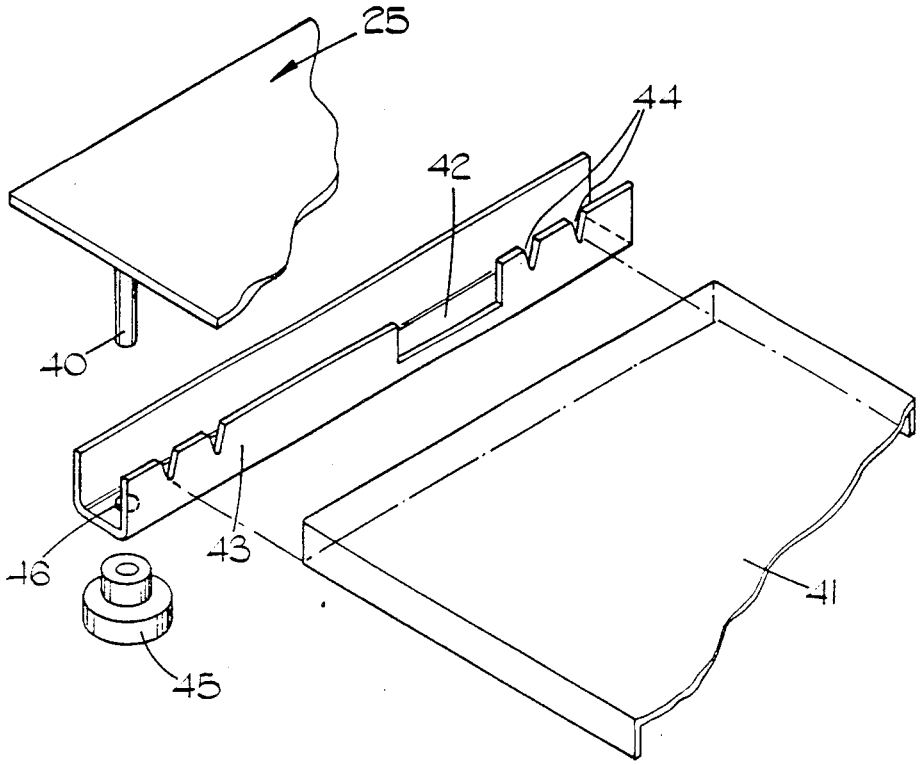
FIG. 9 is an exploded pictorial view of means for securing a power tool to an adaptor plate.

The adaptor plate 25A shown in FIG. 7 is intended for mounting an electrically powered rotary saw of the type commonly made for hand holding. Saws of this type are commercially marked by, for example, Black and Decker and Bosch. The top side of the plate 25A is shown in the drawing. Four threaded studs 40 (FIG. 9) are secured to the underside of the plate 25A at locations designated 40A–40D. Saws of the type disclosed above are provided with a base plate intended for engagement with a workpiece, the base plate having upturned reinforcing and stiffening edges. Part of a base plate 41 is shown in FIG. 9 and this base plate 41 is clamped against the adaptor plate 25A by two channel-section bars 42, only one of which is shown. One limb 43 of each bar 42 is provided with cut-outs 44 through which sides (unnumbered in FIG. 9) of the base plate can pass, the free edge of the limb 43 being urged into clamping engagement with the base plate 41 by nuts 45 engageable with the studs 40 (not shown in FIG. 7; shown representatively in FIG. 9). Each bar 42 is provided with a plurality of cut-outs 44 adapted to engage the edges of a wide range of base plates. The bars 42 extend, in use, between the studs 40 at locations 40A, 40B and at locations 40C, 40D, the studs 40 passing through holes or slots 46. The circular saw blade passes upwardly through a slot 47 in the plate 25A.

An alternative form of plate 25B is shown in FIG. 8 and is intended for use with a jig-saw or a router whose cutting parts pass upwardly through a keyhole opening 50. Threaded one of the studs 40 are welded to the underside of the plate 25B at locations indicated at 40E–40H and 40J–40M. The bars 42 may be provided with holes or slots 46 which are spaced to accomodate the studs on the plate 25B, either in the direction 40E–40H or 40E–40J.

A further type of plate, not shown, may be provided for use with a planer whose cutting cylinder extends upwardly through the plate. It will be understood that other types of adaptor plate may be provided as necessary, to enable additional power tools to be used with the workbench. It is envisaged however that the three plates described above should suffice for most types of tool required to be mounted below the support plane 12.

Figure 12:
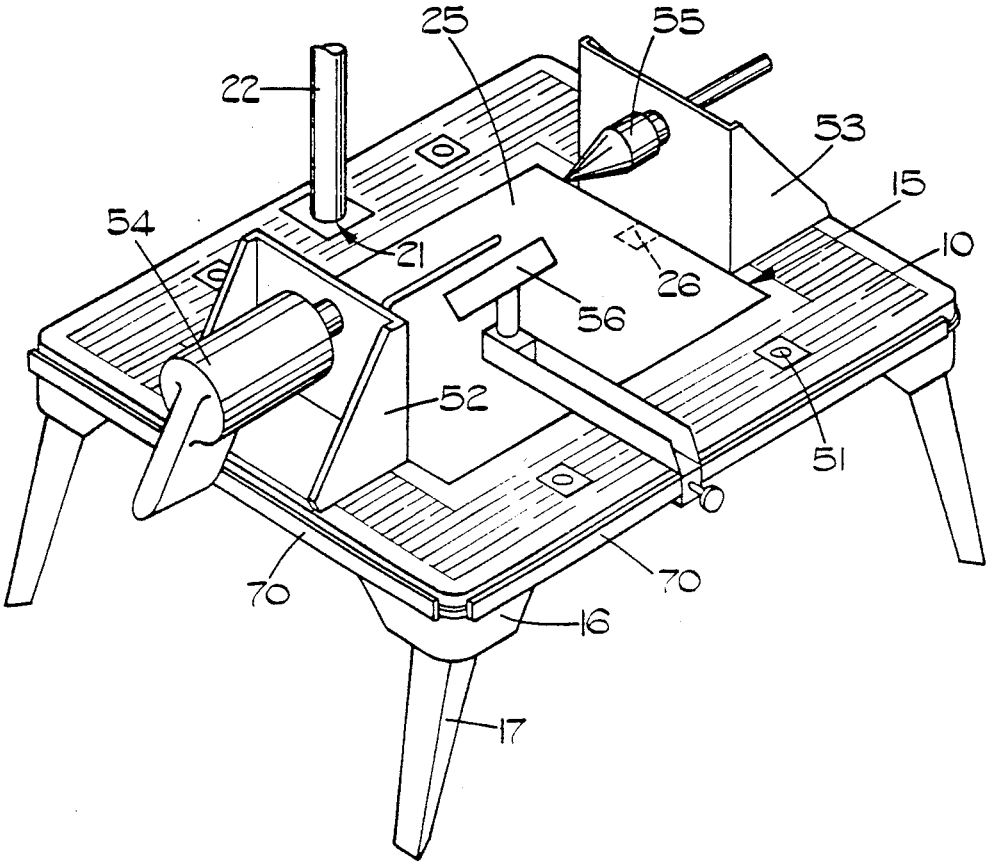
FIG. 12 is a pictorial view of tools mounted on a support plane of the part shown in FIG. 1.

The part 10 (FIG. 1) is provided with eight pads 50 through which the slots 11 do not extend, and through holes 51 centred on the pads 50. The pads 50 and holes 51 provide means by which brackets for power tools or accessories may be secured to the part 10 by means of bolts. Such an arrangement is shown pictorially in FIG. 12, in which brackets 52, 53 are mounted on the part 10 by pairs of the holes 51 and respectively support an electric drill 54 and a tailstock 55. A tool steady 56 is mounted on the part 10 by means of another of the holes 51.

The part 10 is provided with four legs 17 (FIGS. 10 and 11) which are pivotally mounted adjacent the corners of the part 10 and are movable from stowed positions in which they lie diagonally of the part 10 to positions in which they extend downwardly and slightly outwardly of the part 10. As shown in FIGS. 10 and 11 pairs of parallel ribs 60 integral with the remainder of the part 10 extend between the rib 14 and the portions 16 of the ribs 13. A steel channel-piece 61 is secured between the pair of ribs 60 and a leg 17 is mounted on the channel-piece 61 by means of a pivot pin 62. Each side of the channel-piece 61 is formed with a pair of inwardly facing dimples located as shown at 63, 64 respectively in FIG. 10. The dimples 63, 64 are at different radii from the axis of the pin 62. The legs 17 are also of channel section and both arms of each leg 17 adjacent the pin 62 are provided with holes 65, 66 which also lie at different radii from the axis of the pin 62, so that the holes 65, 66 can receive only the respective dimples 63, 64 to hold the legs 17 either in their stowed or deployed positions. The slight outward direction of the legs 17 in their deployed positions maintains the legs 17 in the latter positions under vertical load.

As shown most clearly in FIG. 3 the reinforcing rib 13 has an outwardly extending T-section 70 cast integrally. The section 70 extends along all four sides of the part 10 as shown in FIG. 1.

Figure 13:
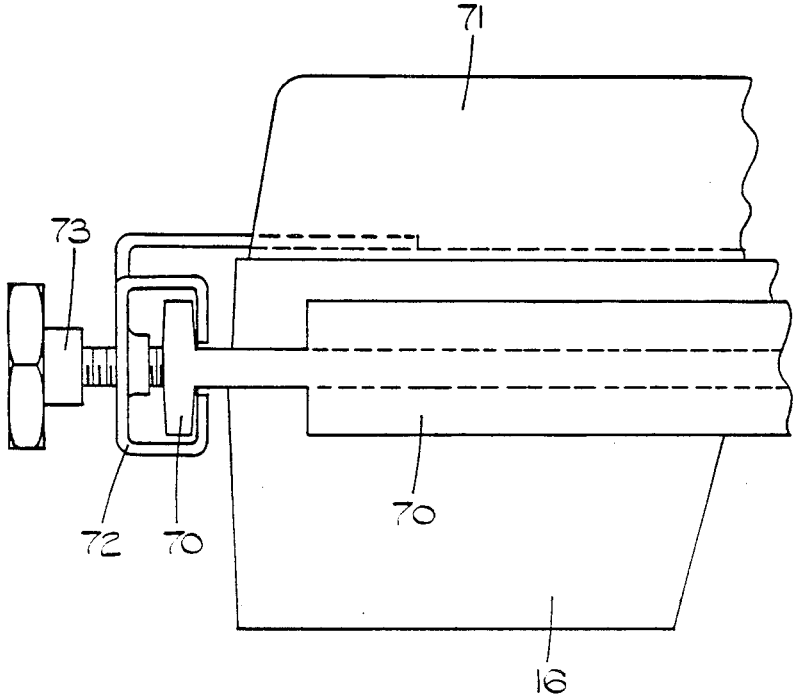
FIG. 13 is a section showing accessory tools mounted to the table.

The section 70 enables accessory parts to be mounted on the part 10, as indicated in FIG. 13, in which a channel-section guide bar 71 includes a welded on clamp 72 which can be drawn into engagement with the section 70 by means of a screw 73.

By providing the top part 10 and a variety of adaptor plates 25 the present invention provides an arrangement by means of which a variety of tools may rapidly and easily be mounted in accurate locations on the part 10. The arrangement is thus particularly suited to small production or domestic use in which a number of articles in a batch is small, and in which the same bench is required for successive operations.

What is claimed is:

1. A workbench comprising in combination: a first part having a generally planar surface having a through aperture and having a plurality of adaptor plates, each of said adaptor plates being separately shaped to fit closely into said aperture so that the surfaces of said adaptor plates are substantially co-planar with said generally planar support surface; each of said adaptor plates being adapted to receive and locate one or more power tools, and a cooperating means on each said plate and said first part for securing each respective said plate in said aperture;

each of said adaptor plates having clamp bars selectively engageable with baseplates of a plurality of power tools, and means for urging said bars toward said plates and into clamping engagement with the baseplates of the plurality of power tools, said clamp bars each being configured as a channel section wherein one limb of section is forward with cut-outs through which sides of a tool baseplate can pass.

2. A workbench according to claim 1 in which said first part has a means for mounting and locating tool-supports thereon.

3. A workbench according to claim 1 in which said first part has along at least one of its sides a T-section extension for engagement with a clamp on an accessory part.

4. A workbench according to claim 1 including a plurality of legs pivotally mounted on said first part, said legs being movable from stowed positions in which they extend inwardly of said first part substantially parallel to said generally planar support surface, and deployed positions in which they extend downwardly of said first part, and detents co-operating with said first part and said legs for selectively maintaining the latter in said stowed or deployed positions.

5. A workbench according to claim 4 in which in their deployed positions, said legs extend slightly outwardly of said first part.

* * * * *